US011167407B2

(12) United States Patent
McGee

(10) Patent No.: US 11,167,407 B2
(45) Date of Patent: Nov. 9, 2021

(54) TRAY AND TOOL CASE

(71) Applicant: Steven McGee, Dallas, TX (US)

(72) Inventor: Steven McGee, Dallas, TX (US)

( * ) Notice: Subject to any disclaimer, the term of this patent is extended or adjusted under 35 U.S.C. 154(b) by 0 days.

(21) Appl. No.: 16/812,275

(22) Filed: Mar. 7, 2020

(65) Prior Publication Data

US 2020/0254605 A1 Aug. 13, 2020

Related U.S. Application Data

(63) Continuation-in-part of application No. 15/210,042, filed on Jul. 14, 2016, now abandoned.

(51) Int. Cl.
*B25H 3/06* (2006.01)
*B25H 3/02* (2006.01)

(52) U.S. Cl.
CPC ..... *B25H 3/06* (2013.01); *B25H 3/02* (2013.01)

(58) Field of Classification Search
CPC ..... B25H 3/02; B25H 3/023; B25H 3/06
USPC ..... 206/372, 373; 248/238
See application file for complete search history.

(56) References Cited

U.S. PATENT DOCUMENTS 4,899,970 A * 2/1990 Berzina ..... E06C 7/14 182/129
5,788,198 A * 8/1998 Sharpe ..... E06C 7/16 248/210
6,443,260 B1 * 9/2002 Katz ..... B25H 3/06 182/129
7,353,911 B1 * 4/2008 Freeman ..... E04G 5/00 182/129
8,881,917 B1 * 11/2014 Sooknanan ..... E04G 5/003 211/70.6
9,714,542 B1 * 7/2017 Harcz ..... E06C 7/14
2006/0192063 A1 * 8/2006 Angotti ..... E06C 7/14 248/210
2007/0181761 A1 * 8/2007 Astor ..... E06C 7/14 248/238
2011/0203873 A1 * 8/2011 Perry ..... E06C 7/14 182/129
2013/0128557 A1 * 5/2013 Pereira ..... E06C 7/14 362/145
2016/0177626 A1 * 6/2016 Miller ..... F16M 11/38 396/419
2017/0014989 A1 * 1/2017 McGee ..... B25H 3/06
2017/0167198 A1 * 6/2017 Goodnow ..... E06C 7/165
2020/0018119 A1 * 1/2020 Ellis ..... E06C 7/16
2020/0270946 A1 * 8/2020 Lawery ..... B44D 3/126

* cited by examiner

*Primary Examiner* — Jacob K Ackun
(74) *Attorney, Agent, or Firm* — Kandace D. Walter

(57) ABSTRACT

A tray and tool case that is hung from the rungs of a ladder or scaffold or closed and carried with tools inside. User may safely and securely store tools on or within the device while engaged in construction projects without climbing off a ladder or scaffold. The device consists of a tray surface with tool openings and rear support leg with tool openings and tool straps, connected to each other with secure fasteners and folding fasteners with locking pins. Three side walls of the tray surface are raised to prevent loss of tools. The device is secured in an open position with secure fasteners like screws, folding fasteners, and locking pins. The closed case is secured with push pin locks after the folding fasteners are folded down but may be opened when the push pink locks are disengaged and the curved opening is used to pull the device open.

11 Claims, 8 Drawing Sheets

TRAY AND TOOL CASE

The present disclosure relates generally to a support tray and, in particular, to a tray for storing work tools while working on a scaffold or ladder.

BACKGROUND

Scaffolds and ladders are commonly used by work crews during construction or repair on buildings, houses, bridges and other structures. Scaffolds and ladders are particularly helpful and useful when the workers must be elevated to a significant height away from the ground in order to perform the work tasks. Often times, tools are required to perform the work tasks. Workers typically place the tools on or adjacent to the scaffold or ladder surface, which presents a hazard for the tools (which may roll, fall and/or break), the worker (who may drop and damage a tool, trip on a tool and fall from the scaffold or ladder, or drop a tool to the ground below, possibly endangering unsuspecting passersby. Alternatively, a worker may try to balance the tool between their legs or between their arm and torso in order to multitask without setting the tool on the scaffold or ladder and thereby endangering themselves or passersby. To resolve this issue, scaffold trays and ladder trays have been created and improved upon over the years. However, prior embodiments of the scaffold tray and ladder tray have multiple limitations such as accommodating round or square rungs of a scaffold or ladder but not universal fit for any rungs, not folding for easy storage, and not having storage space for tools.

OBJECTIVES

An object of one embodiment of the present disclosure is to provide a sturdy and secure resting area for tools in use by a worker on a scaffold or ladder.

Another object of the present disclosure is to provide a mobile storage space for worker's tools within the scaffold tray.

Another object of the present disclosure is to provide a scaffold tray that can universally fit virtually any scaffold or ladder rung shape or size.

Another object of the present disclosure is to provide a scaffold tray that can fold and collapse for storage and transport.

Another object of the present disclosure is to provide a scaftbld tray which can be temporarily adapted for longer scaffold platforms.

Another object of the present disclosure is to provide a scaffold tray which can be temporarily adapted for use with a ladder.

SUMMARY

Embodiments of the present disclosure generally provide an improved tray and tool case ("TTC") for use with a scaffold or ladder that attaches to the horizontal rung of a scaffold or ladder. The TTC is comprised of a tray surface, rear support leg, fasteners, folding supports, push button locks, and locking pins. The tray surface and support leg are attached to each other with secure metal fasteners and folding fasteners or supports, which may be further secured with locking pins. The rear support leg may be individual legs or a single rear leg unit, as in this embodiment. The folding supports allow the TTC to fold for storage and unfold for attachment to the horizontal rung of a scaffold or a ladder. When the ITC is folded, tools may be stored inside the TCC. When the TTC is unfolded, tools may be stored or placed in the holes or slots on the tray surface platform or against the interior of the rear support leg with tool straps through the rear support leg openings. A ladder accessory may be used to facilitate use of TTC with a ladder in place of a scaffold.

The tray surface is comprised of a flat, elongated tray platform with tray surface openings (round and elongated slots) surrounded by a tray surface front wall, tray surface rear wall, and two tray surface side walls to the left and right of the tray platform. The tray surface openings run from the exterior of the tray surface to the interior of tray surface in order to facilitate the insertion of tools into the open TIC while TC is positioned on a ladder or scaffold. The two tray surface side walls and tray surface front wall are higher than the tray platform to prevent tools from rolling off the edges of the TIC. The rear edge of the tray surface rear wall is level with the tray platform and would be adjacent to the scaffold or ladder in use to prevent tools placed on the surface from rolling away. The tray surface front wall has a pair of holes that with correspond to push button locks on the front edge of the rear support leg. When the TTC is closed, the push button locks of the rear support leg may be depressed in order to enter the pair of holes on the tray surface front wall. Once the push button locks and push button holed are engaged, the push button locks rise through the push button holes to lock the TTC. The tray surface front side wall also includes a strap for carrying the closed TTC. The tray surface openings may accommodate tools and other items for storage on the TTC. A user may place tools such as hammers, screw drivers, or putty knives through the holes or slots for storage while not in use during a project. The tray surface has dual rung cut out sections on both the tray surface left side wall and the tray surface right side wall, which facilitate the placement of the tray surface on the rung of the scaffold. The dual rung cut out sections are circular and round in this embodiment but may also be constructed with straight edges to accommodate square shaped rungs. Additionally, the size of the rung cut-out sections may vary to accommodate rungs of different diameters. The rung cut outs further secure or hook the tray surface to the scaffold rung.

A TTC ladder accessory may be used to adapt the TTC for use on a ladder. The ladder accessory is comprised of a bar permanently attached to a pair of perpendicular legs, wherein the bar would rest in the rung cut-out sections of TTC while the pair of perpendicular legs would rest across corresponding rungs (top rungs, second pair of rungs, bottom rungs, etc.) of the ladder. In use, the exterior of the rear leg of the TTC would rest against the ladder surface while the user climbs the opposite side of the ladder to continue work on the designated project with tools readily accessible on the tray surface of TTC.

The rear support leg is perpendicular to the tray surface, creating a ninety (90) degree angle between the tray surface and rear support leg when TTC is open. The rear support leg is covered in a series of slots and openings, which provide ventilation and may be used with tool straps to secure tools to the interior surface of the rear support leg. Further, the rear support leg also includes a hinged door opening in the midsection of the interior surface of the rear support leg to accommodate longer scaffold platforms that may push through TTC. When TTC is removed from the scaffold with the longer platform, the hinged door opening will close again and remain flat. When TTC is closed, the rear support leg folds under the tray surface to create the tool case component. The front wall of the rear support leg of TTC also includes a curved opening for the insertion of the user's hand or other item to pull the TTC open and expose the interior of TTC. The rear support leg is attached to the tray surface with secure fasteners, such as screws, rivets, or bolts, which route through both the rear support leg and tray surface. In addition, the side walls of the rear support leg are connected to the side walls of the tray surface by folding fasteners with locking pins. The perimeter of the rear support leg is slightly smaller than the perimeter of the tray surface such that the rear support leg folds beneath the tray surface to create the tool case. When the folding fasteners are fully extended, the rear support leg and tray surface are separated by a ninety-degree angle. To secure this ninety-degree positioning, a locking pin may be inserted into the folding fastener. When the locking pin is removed, the folding fastener may be closed and the rear support leg folded underneath the tray surface. Tools, which are not currently in use, may also be stored against the interior surface of the rear support leg with tool straps. While the tray surface hooks on a rung, the support leg rest against the rung(s) immediately below the rung on which the tray surface is hooked.

A right folding fasteners connects the tray surface right side wall to the rear support leg right side wall. A left folding fastener connects the tray surface left side wall to the rear support leg left side wall. The folding fasteners between the stray surface side walls and rear support leg side walls permit the TTC to collapse for storage and moving between work locations. The carrying strap on the tray surface front wall may also be used for carrying TTC between locations. Additionally, tools may be stored against the interior surface of the rear support leg. Tools placed against the interior surface of the rear support leg may be secured with tool straps through the openings on the rear support leg. Tool straps may be threaded through openings on the interior surface of the rear support leg. Tools may be placed against the interior surface of the rear support leg and secured to its interior by closing tool straps around the tools. The TTC can be used with various scaffold rung settings, scaffold heights, width of scaffold rung, distance between rungs, and scaffold rung shapes. The light weight TTC is convenient to carry and may be used for square and round scaffold legs, small/medium/large scaffolds, and the TTC is collapsible and can be used as a tool carrying case as well as a scaffold tray. Other technical features may be readily apparent to those skilled in the art from the following figures and descriptions.

BRIEF DESCRIPTION OF THE DRAWINGS

For a more complete understanding of this disclosure and its features, reference is now made to the following description, taken in conjunction with the accompanying drawings, in which.

REFERENCE NUMBERS

Figure 1:
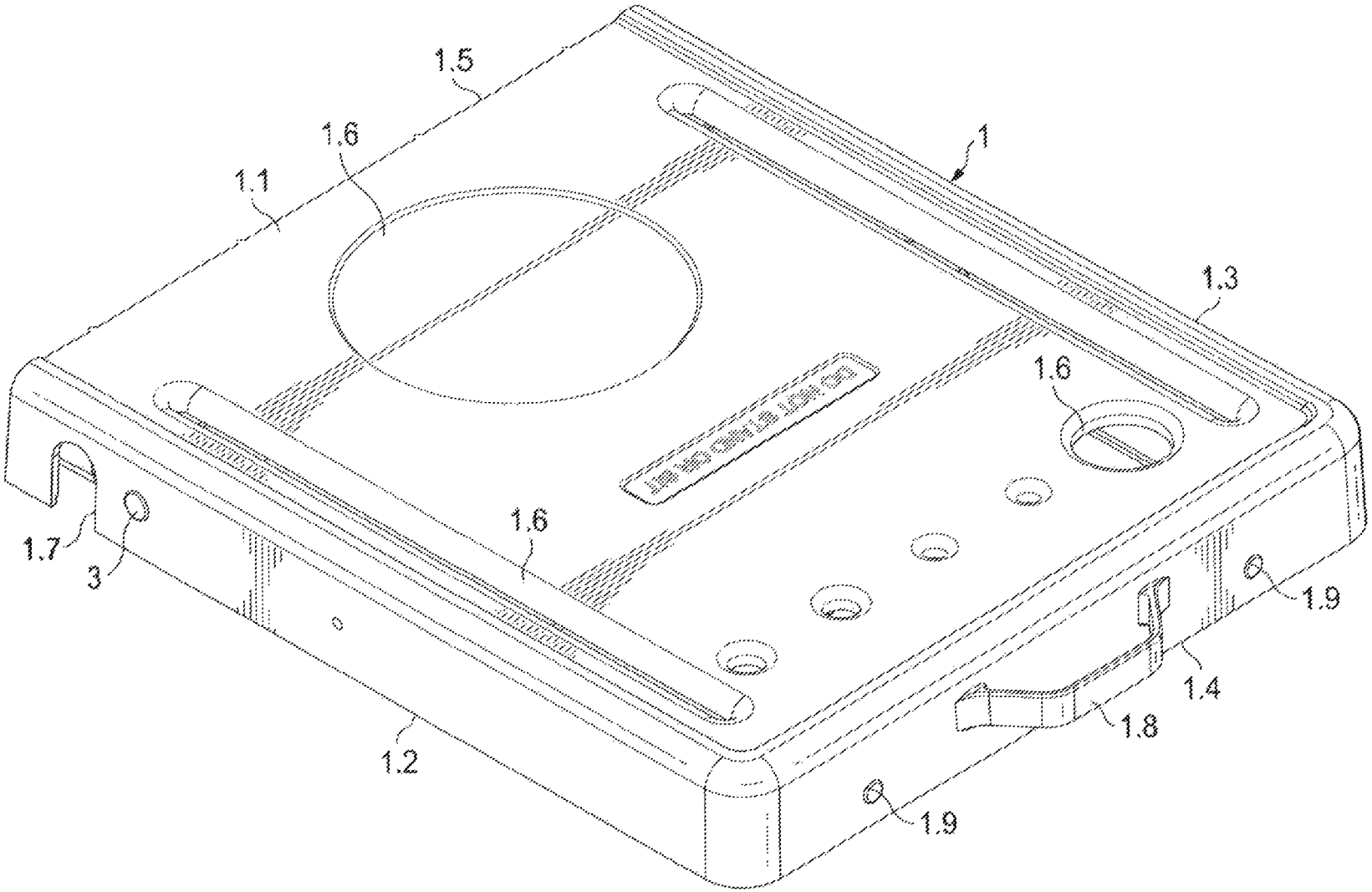
FIG. 1 is a top perspective view of the exterior of the tray surface of TTC.

1. Tray Surface
- 1.1 tray platform
- 1.2 tray surface left side wall
- 1.3 tray surface right side wall
- 1.4 tray surface front wall
- 1.5 tray surface back wall
- 1.6 tray surface openings
- 1.7 rung cut-outs
- 1.8 carrying strap
- 1.9 push pin lock holes

2. Rear Support Leg
- 2.1 rear support leg surface
- 2.2 rear support leg left side wall
- 2.3 rear support leg right side wall
- 2.4 rear support leg front wall
- 2.5 rear support leg back wall
- 2.6 hinged door
- 2.7 rear support leg slots or openings
- 2.8 tool straps
- 2.9 push pin locks
- 2.10 curved opening

3. Secure fasteners

4. Folding Fasteners

5. Locking pins

6. Ladder
- 6.1 ladder accessory bar
- 6.2 ladder accessory legs
- 6.3 ladder rungs

7. Scaffold
- 7.1 scattold rung
- 7.2 scaffold platform

8. Tool

DETAILED DESCRIPTION

The present disclosure for the TTC generally provides a scaffold tray and tool case for holding and storing work tools in a secure manner on a scaffold. It should be understood that reference numbers shown in the figures are for illustrative purposes only and that any other system or subsystem could be used in conjunction with or in lieu of these reference numbers according to one embodiment of the present disclosure.

FIG. 1 is a top perspective view of the exterior of the tray surface 1 of TTC. The tray surface consists of a tray platform 1.1 surrounded by a left side wall 1.2, right side wall 1.3, front wall 1.4 and back wall 1.5. The back wall 1.5 is flush with the tray platform 1.1 while the left side wall 1.2, right side wall 1.3, and front wall 1.4 are raised to prevent tools placed on the tray platform 1.1 from rolling away. The tray surface 1 also includes a series of surface openings 1.6 on the tray platform of varying sizes to accommodate different tools. Tools may be placed in the tray surface openings 1.6 or laid on the tray platform 1.1. Each side wall 1.2, 1.3 has a rung cut-out 1.7 from which the TTC would be placed on the rung of a ladder or scaffold. A secure fastener 3, such as screw, rivet, or bolt, connects the tray surface 1 to the rear support leg 2, which is further secured by the folding fastener 4 and locking pin 5. When the TTC is closed, the push pin lock holes 1.9 on the tray surface front wall 1.4 accept the push pin locks 2.9 on the rear support leg front wall 2.4. The closed TTC may also be transported with the carrying strap 1.8.

Figure 2:
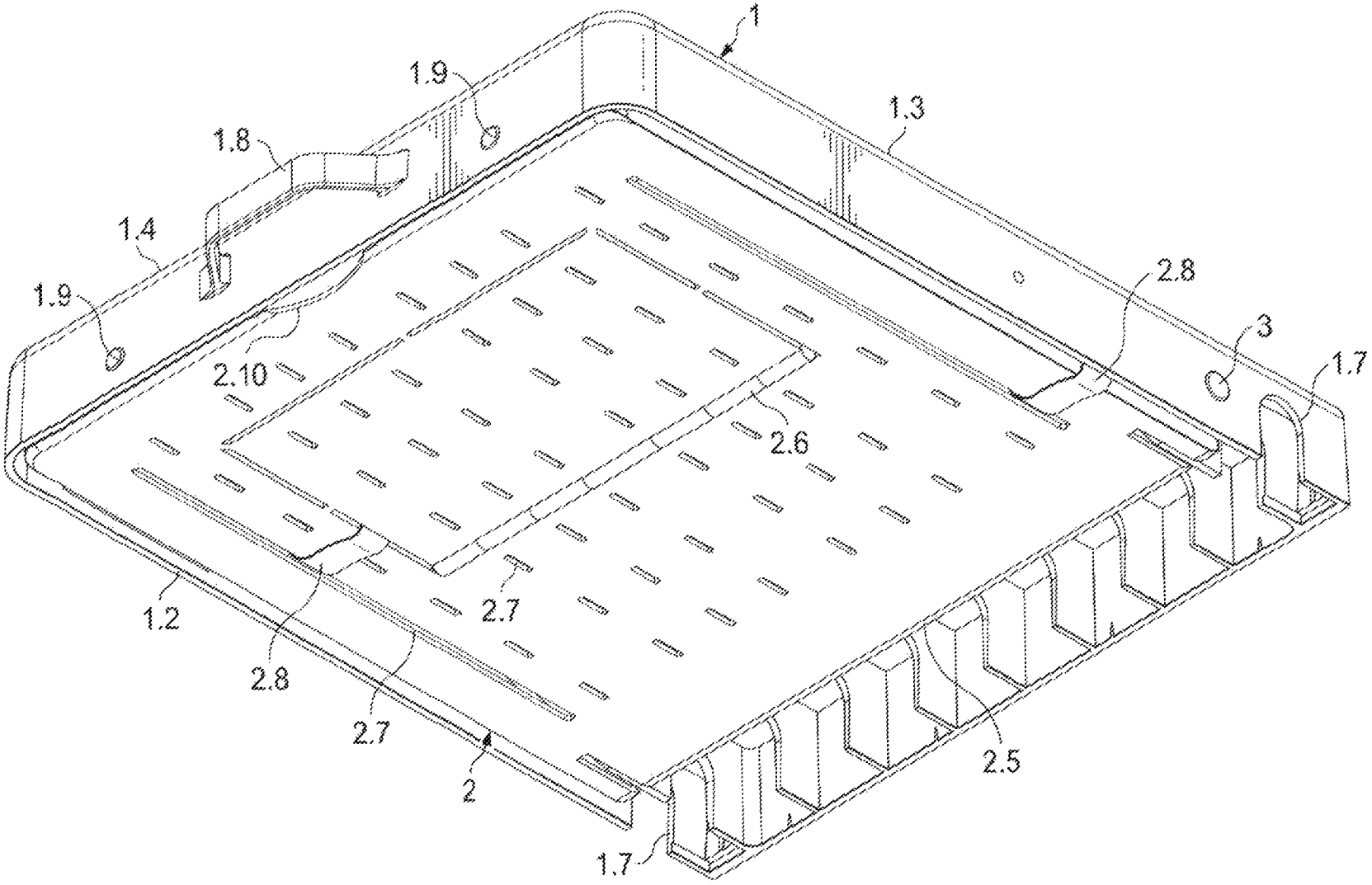
FIG. 2 is a bottom perspective view of the exterior of rear leg of TTC.

FIG. 2 is a bottom perspective view of the exterior of rear leg 2 of TTC. The perimeter of the rear support leg 2 is slightly smaller than the perimeter of the tray surface 1 such that the rear support leg 2 folds underneath the tray surface 1 when the TTC is closed. In a closed position, the folding fasteners 4 are closed as well and the push pin locks 2.9 are engaged with the push pin lock holes 1.9. Tools may be stored against the interior surface of the rear support leg 2, while also being enclosed inside the TTC. The closed TTC may be transported by picking up the TTC by the carrying strap 1.8 on the tray surface front wall 1.4. Each tray surface side wall 1.2, 1.3 has a rung cut-out 1.7 from which the TTC would be placed on the rung of a ladder or scaffold. A secure fastener 3, such as screw, rivet, or bolt, connects the tray surface 1 to the rear support leg 2, which is further secured by the folding fastener 4 and locking pin 5. The closed TIC may be opened by disengaging the push pin locks 2.9 and inserting fingers or a tool into the curved opening 2.10 to pull the rear support leg 2 apart from the tray surface 1 of TTC. When the open TTC is used with a longer scaffold, the extra scaffold length may pass through the hinged door 2.6 of the rear support leg 2. When the TTC is removed from the longer scaffold, the hinged door 2.6 will close again. The hinged door 2.6 has hinges on one side connecting the rear support leg surface 2.1 and one edge of the hinged door. The remaining edges of the hinged door 2.6 remain adjacent to but unconnected to the rear support leg surface 2.1. The rear support leg 2 includes a series of slots or openings 2.7 of small and larger sizes to accommodate various tools and tools straps 2.8, which may be used to secure tools to the rear support leg surface 2.1 during use or storage of TC. These rear support leg slots 2.7 run from the exterior of the rear support leg to the interior of the rear support leg to accommodate tool straps 2.8 and ventilation. In this view, the rung cut outs 1.7 are empty as the TTC is not in use on a scaffold or ladder. The interior of the tray surface back wall 1.5 includes support structures to increase the sturdiness of TTC, by supporting the top of the rear support leg 2, when placed on a rung. The rear support leg front wall 2.4 includes the push pin locks 2.9 to facilitate securing a closed TTC as well as the curved opening 2.10 to facilitate opening TTC. Tools may be placed through tray surface openings 1.6 on the tray platform. Tools may also be secured to the rear support leg 2 with tool straps 2.8 threaded through rear support leg slots and openings 2.7. Folding fasteners 4 are located between the rear support leg right side wall 2.3 and the tray surface right side wall 1.3 as well as between the rear support leg left side wall 2.2 and the tray surface left side wall 1.2. Folding fasteners 4 may be locked with locking pins 5 to prevent TTC from collapsing or closing during use on a scaffold or ladder. Secure fasteners 3 also connect the tray surface 1 to the rear support leg 2.

Figure 3:
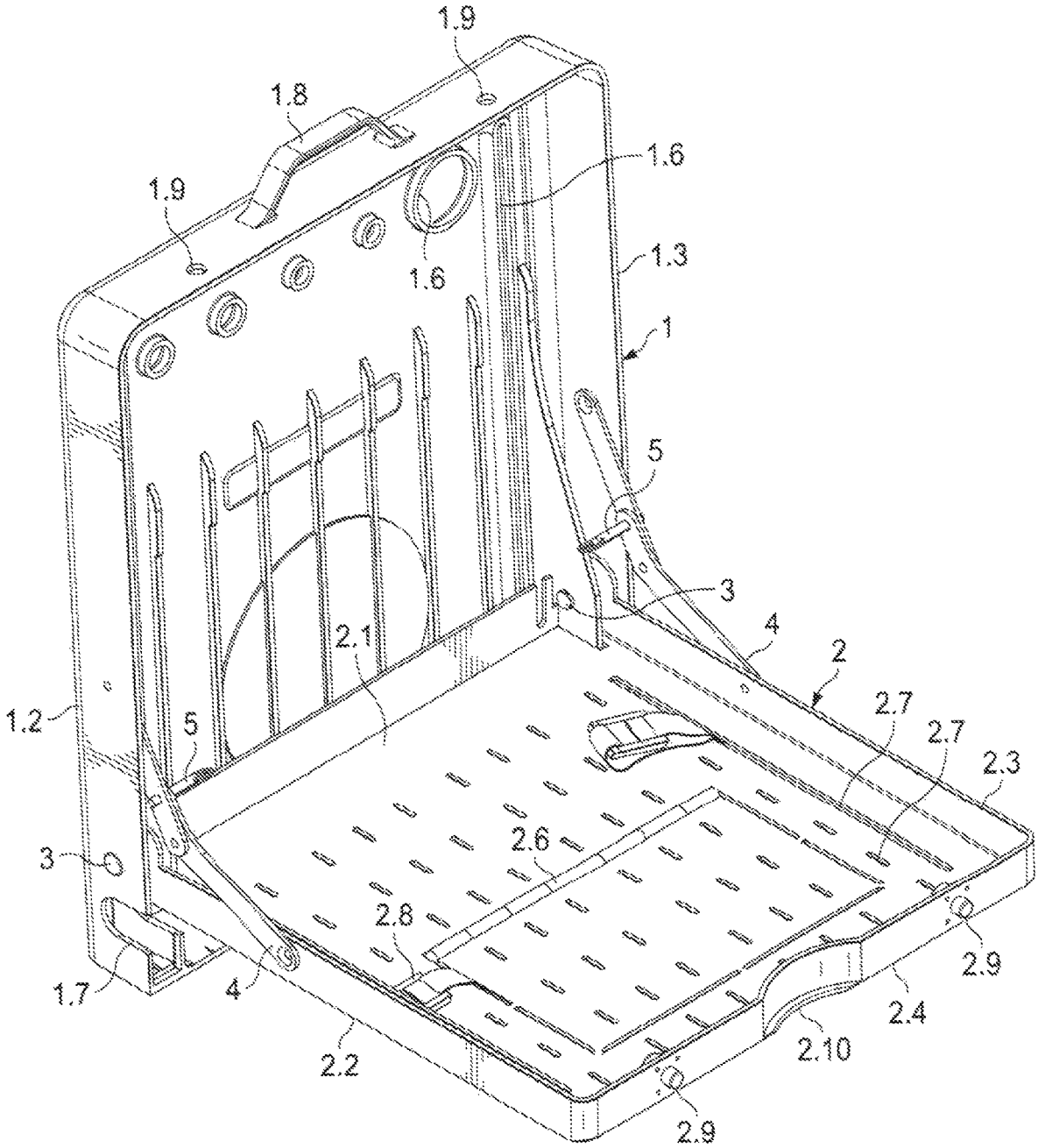
FIG. 3 is top perspective view of the interior of TTC

FIG. 3 is top perspective view of the interior of TTC. Both the interior of the tray surface 1 and interior of the rear support leg 2 are visible in this view. Here. TTC is shown in an open position without being placed on a rung of scaffold or ladder. The tray surface front wall 1.4 includes the carrying strap 1.8 and push pin lock holes 1.9. The underside of the various tray surface openings 1.6 is also shown on the interior of the tray surface 1. The secure fastener 3 passes through both the tray surface 1 and the rear support leg 2. The secure fastener 3 and rung cut out 1.7 are shown on the tray surface left side wall 1.2, which is opposite of the tray surface right side wall 1.3. The hinged door 2.6, tool straps 2.8, as well slots and openings 2.7 are shown on the rear support leg surface 2.1 at the interior of the rear support leg 2. The rear support leg left side wall 2.2 is opposite the rear support leg right side wall 2.3. The rear support leg front wall 2.4 includes the curved opening 2.10 surrounded by a pair of push pin locks 2.9. The folding fasteners 4 are positioned between the tray surface 1 and the rear support leg 2. The locking pins 5 are inserted into the folding fasteners 4 to secure the open position of TTC in this view.

Figure 4:
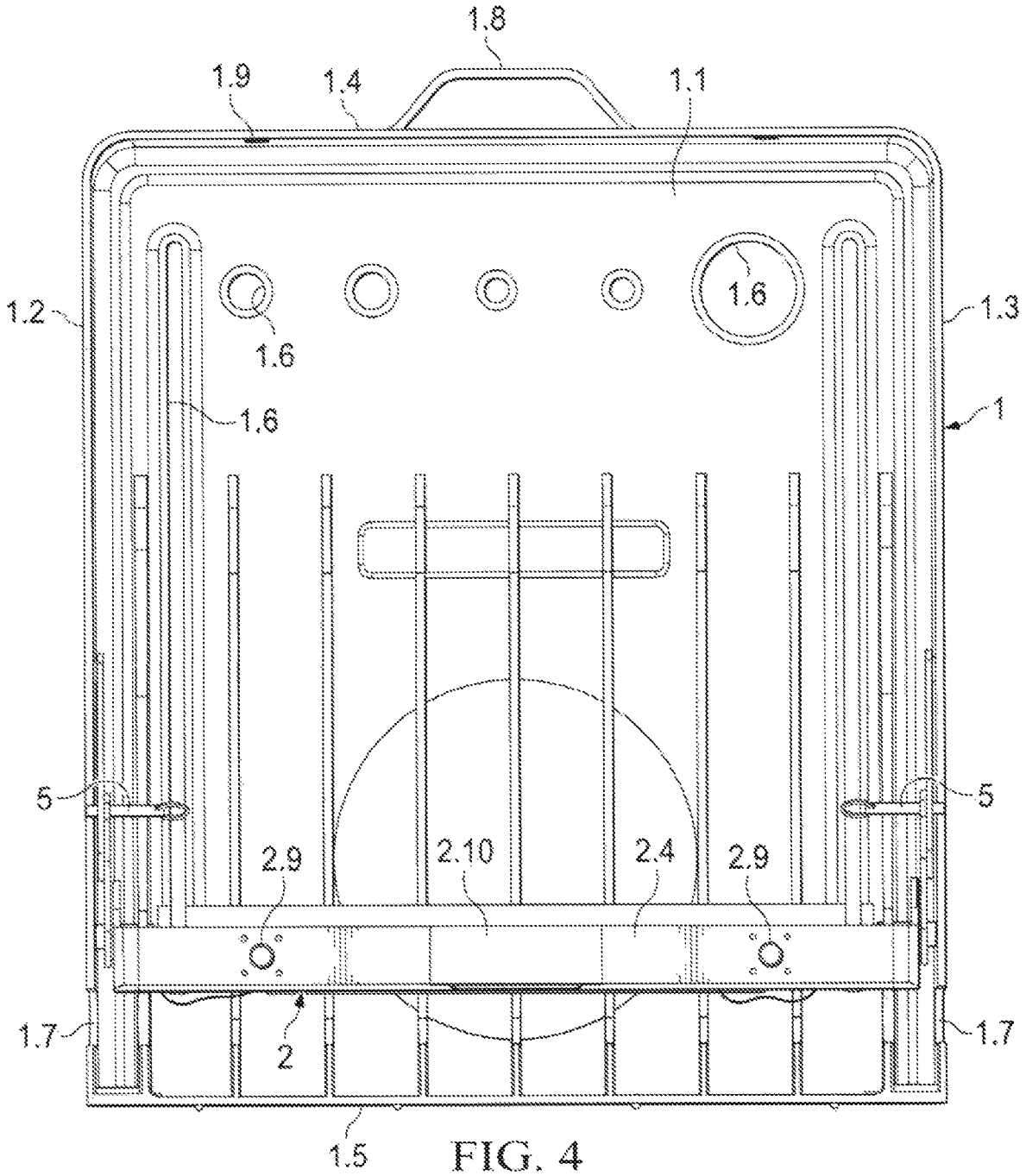
FIG. 4 is a side perspective view of the interior of TTC.

FIG. 4 is a front perspective view of the interior of TTC. The rear support leg front wall 2.4 with push pin locks 2.9 and curved opening 2.10 is also visible in this view. The interior of the tray surface 1 also shows the underside of the tray surface openings 1.6. The carrying strap 1.8 and push pin lock holes 1.9 are located on the front wall 1.4 of the tray surface. The folding fasteners 4 and locking pins 5 are between the tray surface 1 and rear support leg 2. The empty rung cut outs 1.7 are located on the tray surface left side wall 1.2 and tray surface right side wall 1.3. Folding fasteners 4 may be locked with locking pins 5 to prevent TTC from collapsing or closing during use on a scaffold or ladder. The tray surface back wall 1.5 is also visible underneath the open TTC, when the rear support leg 2 is at a ninety-degree angle to the tray surface 1.

Figure 5:
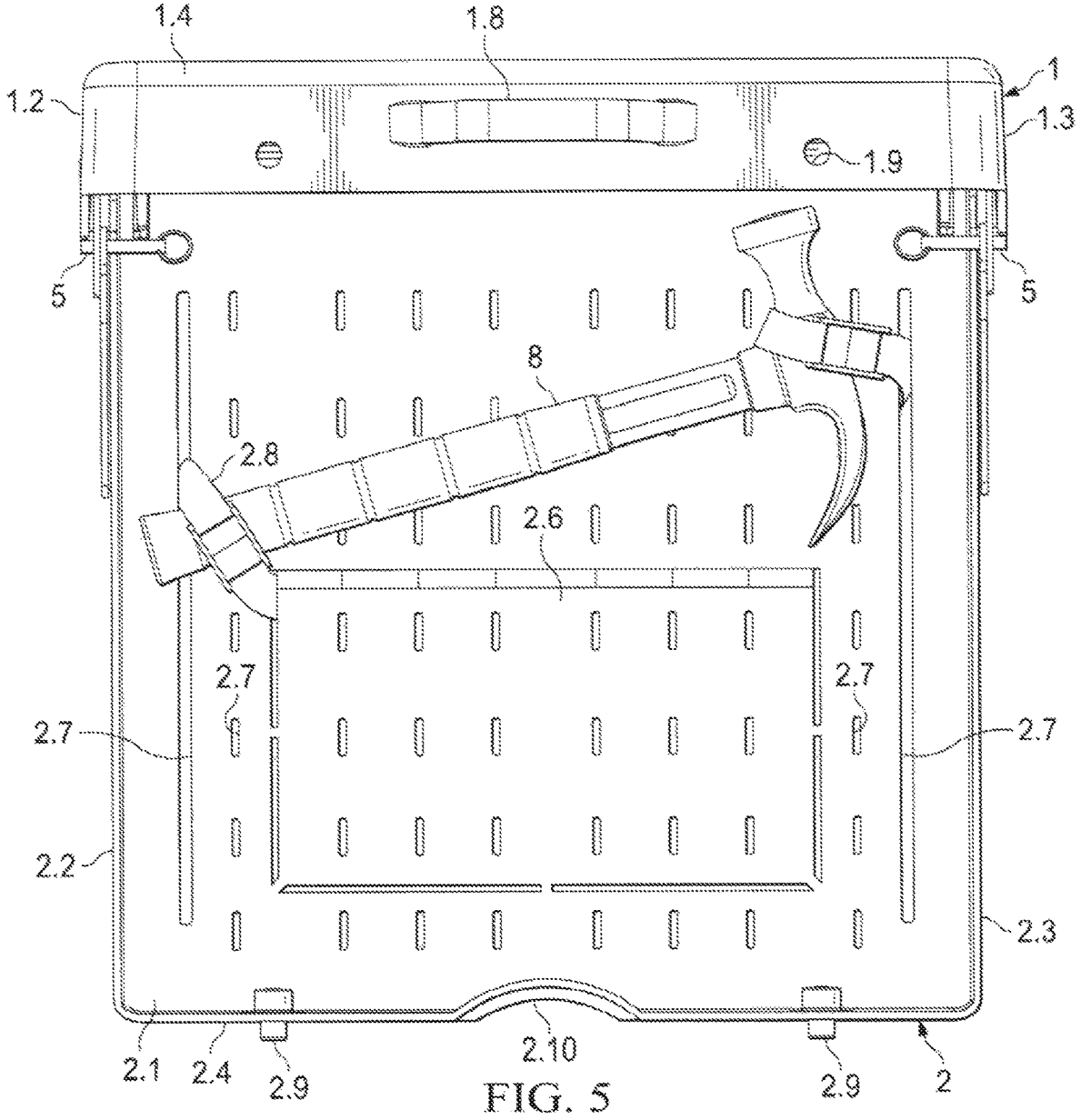
FIG. 5 is a top perspective view of the interior of the rear support leg of ITC.

FIG. 5 is a top perspective view of the interior of the rear support leg 2 of TTC. The tray surface front wall 1.4, with carrying strap 1.8 and push pin lock holes 1.9 are also visible in this view. The rear support leg surface 2.1 includes a hinged door 2.6 for longer scaffold platforms, slots or openings 2.7 and tools traps 2.8 to secure tools 8, such as a hammer in this embodiment, to the rear support leg 2. Folding fasteners 4 with locking pins 5 are also used to facilitate the opening and closing of TTC and security of TTC while placed on a rung of a ladder or scaffold. The curved opening 2.10 and push pin locks 2.9 are also visible on the front wall of the rear support leg 2.4. The rear support leg left side wall 2.2 is opposite the rear support leg right side wall 2.3. The tray surface left side wall 1.2 is opposite of the tray surface right side wall 1.3.

Figure 6:
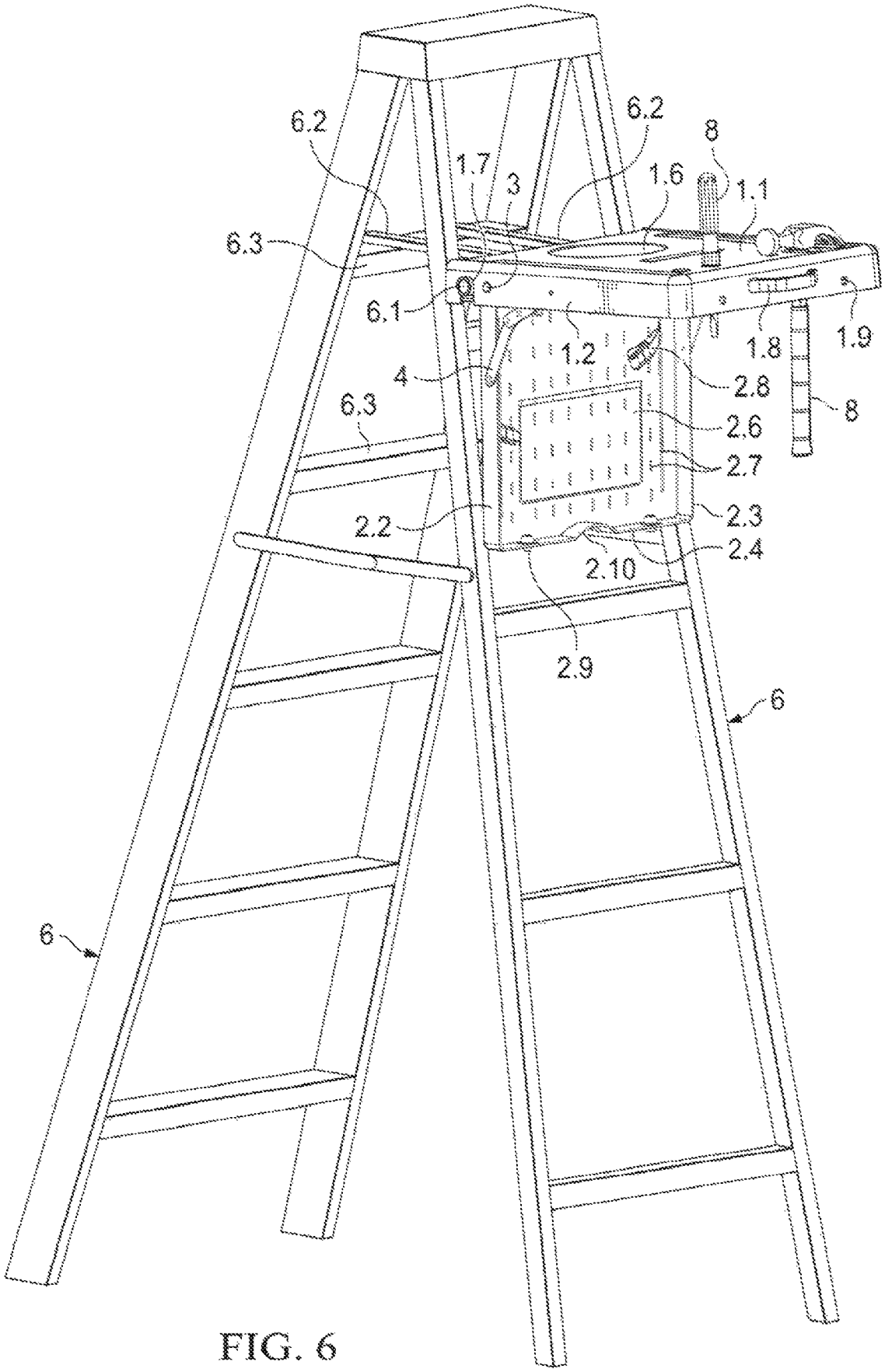
FIG. 6 is side perspective view of the TYC with accessory on a ladder.

FIG. 6 is side perspective view of the TIC with ladder accessory on a ladder 6. TTC may be used with a ladder accessory composed of a pair of ladder accessory legs 6.2 connected to a ladder accessory bar 6.1 at a ninety-degree angle. The rung cut outs 1.7 of TTC are placed atop the ladder accessory bar 6.1 and the pair of ladder accessory legs 6.2 are then placed across corresponding rungs 6.3 of the ladder 6 to maintain a level TIC. The rear support leg 2 of TTC rests adjacent to the ladder rungs 6.3 below the ladder rung where the ladder accessory legs 6.2 are resting. The tray surface front wall 1.4 includes the carrying strap 1.8 and push pin lock holes 1.9. The tray surface side walls 1.2/1.3 include rung cut-outs 1.7 and secure fasteners 3. The rear support leg 2 includes slots or openings 2.7, tool straps 2.8, and hinged door 2.6. The rear support leg front wall 2.4 includes the curved opening 2.10 and push pin locks 2.9. The rear support leg left side wall 2.2 is opposite the rear support leg right side wall 2.3. The tray surface 1 includes openings 1.6 for the placement of tools 8 while the TTC is in use. A user may use the TTC and ladder accessory to store the necessary supplies for a particular job on one side of the ladder 6 and climb the opposite side of the ladder to perform the task and access tools 8 placed on the TTC while working.

Figure 7:
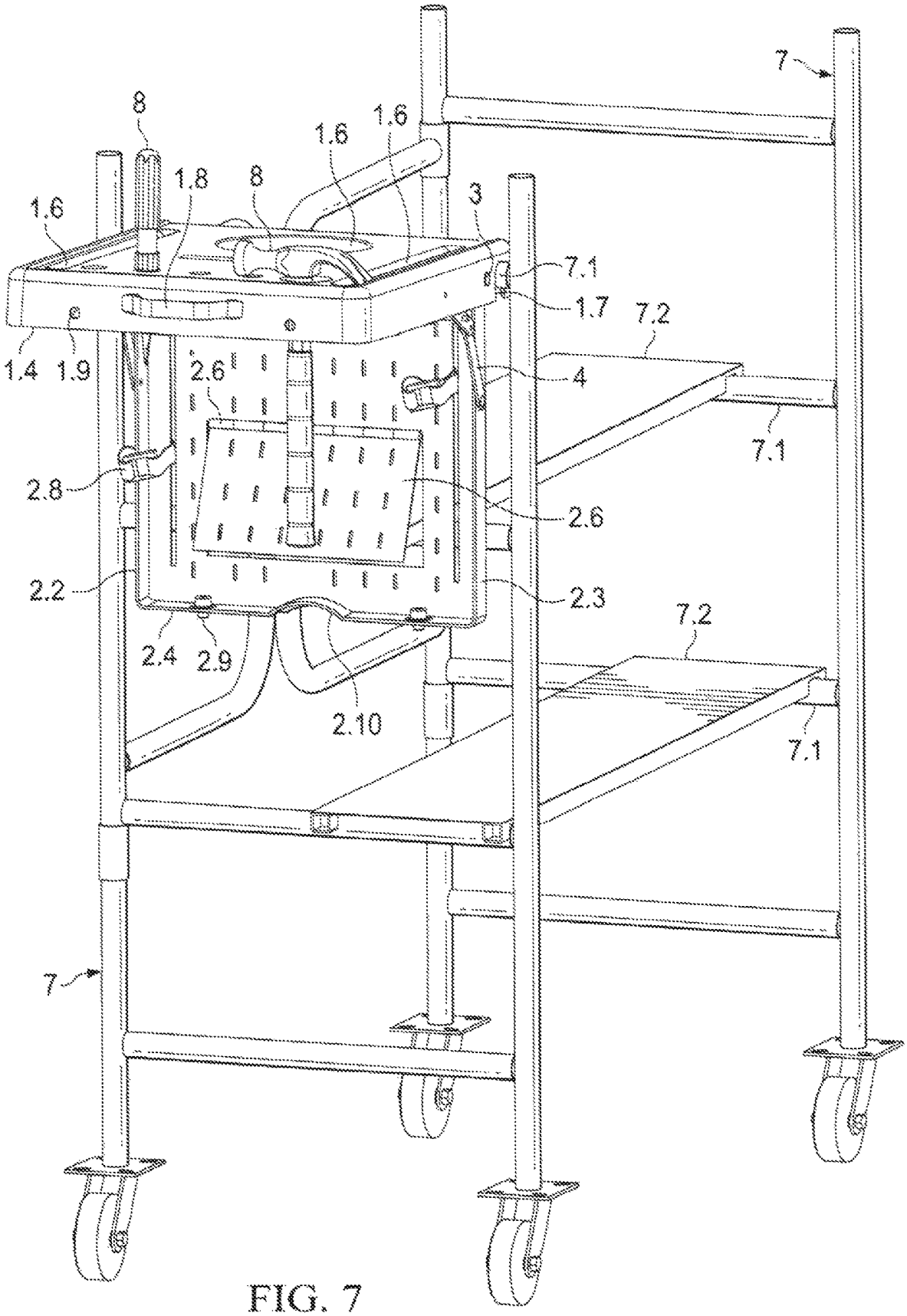
FIG. 7 is a side perspective view of the TTC with open rear support leg hinged door.

FIG. 7 is a side perspective view of the TTC with open rear support leg hinged door 2.6 attached to a small scaffold 7. A user may stand on the scaffold platform 7.2 and access tools 8 placed on the tray surface 1 of the TTC. In use, the rung cut out 1.7 of the TTC is placed on a rung 7.1 of a scaffold 7. Depending on the length of the scaffold platform 7.2, the scaffold platform 7.2 may or may not push through the hinged door 2.6 of the rear support leg 2. The rear support leg left side wall 2.2 is opposite the rear support leg right side wall 2.3. The hinged door 2.6 of TIC allows TTC to accommodate scaffolds 7 with longer platforms 7.2 without compromising the security and placement of the TTC. The secure fastener 3 passes through both the tray surface 1 and the rear support leg 2 while the folding fasteners 4 also connect the tray surface 1 and the rear support leg 2 and make the TTC collapsible when locking pins are removed from folding fasteners 4. The rear support leg 2 includes a series of slots or openings 2.7 to accommodate various tools 8 and tool straps 2.8, which may be used to secure tools 8 to the rear support leg 2. The rear support leg front wall 2.4 includes the curved opening 2.10 and push pin locks 2.9. The tray surface also includes a series of surface openings 1.6 on the tray platform 2.1 of varying sizes to accommodate different tools 8. The closed TTC may also be transported with the carrying strap 1.8 on the tray surface front wall 1.4, which also includes the push pin lock holes 1.9.

Figure 8:
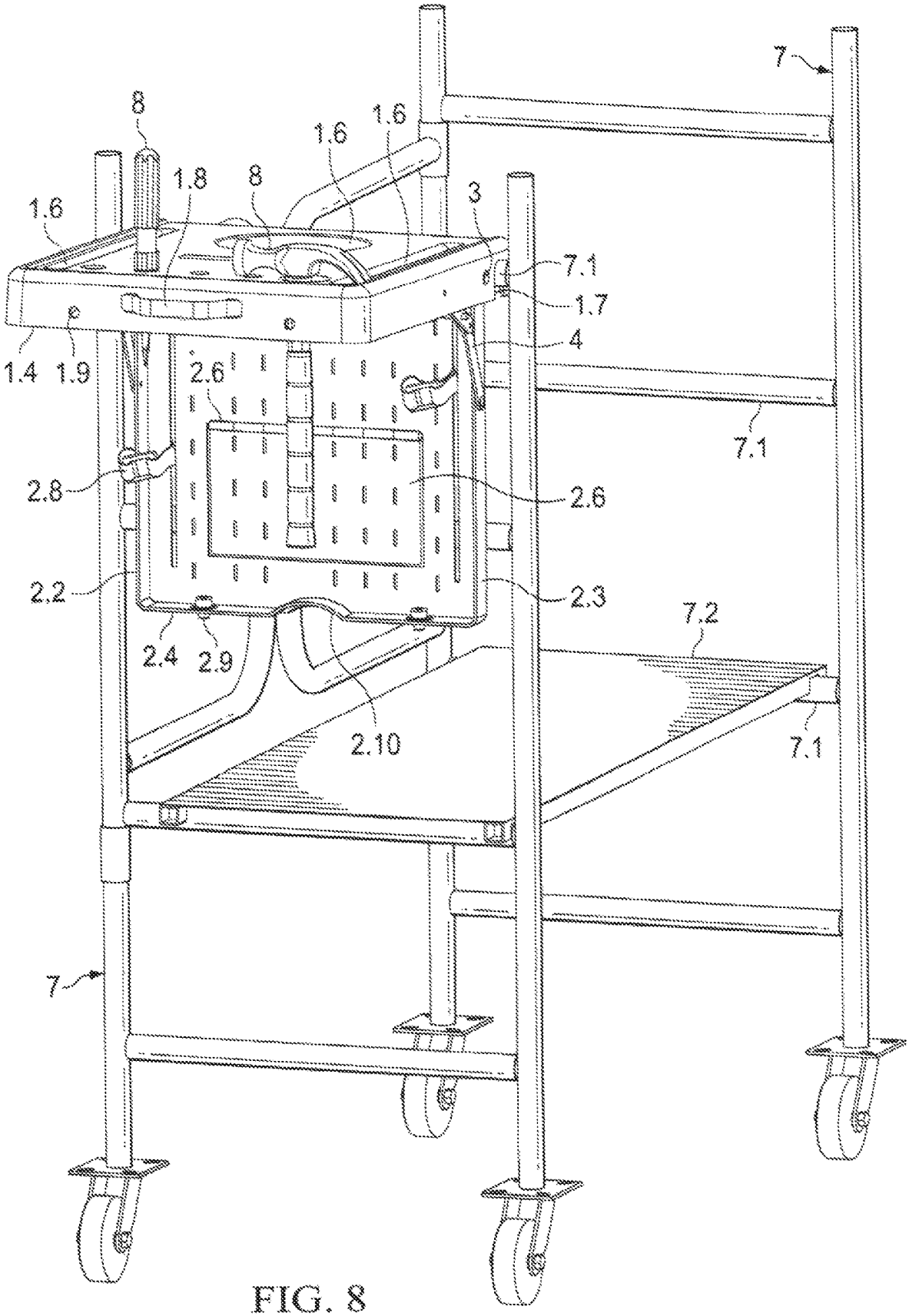
FIG. 8 is a side perspective view of the tTC on a large scaffold.

FIG. 8 is a side perspective view of the TTC on a large scaffold. In this view, the hinged door 2.6 remains closed since there is no need to accommodate a longer scaffold platform. A user may stand on the scaffold platform 7.2 and access tools 8 placed on the tray surface 1 of the TTC. In use, the rung cut out 1.7 of the TTC is placed on a rung 7.1 of a scaffold. The rear support leg 2 includes a series of slots or openings 2.7 to accommodate various tools 8 and tools straps 2.8, which may be used to secure tools 8 to the rear support leg 2. The tray surface 1 also includes a series of surface openings 1.6 on the tray platform 1.1 of varying sizes to accommodate different tools 8. The closed TTC may also be transported with the carrying strap 1.8 on the tray surface front wall 1.4, which also includes the push pin lock holes 1.9. The secure fastener 3 passes through both the tray surface 1 and the rear support leg 2 while the folding fasteners 4 also connect the tray surface 1 and the rear support leg 2. The rear support leg front wall 2.4 includes the curved opening 2.10 and push pin locks 2.9.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith." as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure and the following claims.

What is claimed is:

1. An improved tray and tool case comprising:

a tray having a tray surface with openings, back wall, a front wall, a left side wall, and a right side wall;

a rear support leg having a leg surface with openings, a back wall, front wall, a left side wall, and a right side wall;

a secure fastener connecting said tray surface to said rear support leg;

a folding fastener connecting said tray left side wall to said rear support leg left side wall and a folding fastener connecting said tray right side wall to said rear support leg right side wall.

2. The improved tray and tool case of claim 1 wherein said tray back wall is level with said tray surface; wherein said tray front wall is taller than said tray surface, wherein said tray left side wall is taller than said tray surface, wherein said tray right side wall is taller than said tray surface.

3. The improved tray and tool case of claim 2 said tray surface openings extend from the exterior of said tray surface to the interior of said tray surface, wherein rear support leg openings extend from the exterior of said rear support leg to the interior of said rear support leg.

4. The improved tray and tool case of claim 1 wherein said secure fastener is selected from the group consisting of: screw, rivet, and bolt.

5. The improved tray and tool case of claim 1 wherein said folding fastener is further secured with a locking pin.

6. The improved tray and tool case of claim 5 wherein a locking pin inserted into said folding fastener secures the position of said folding fastener.

7. The improved tray and tool case of claim 1, wherein said rear support leg surface is further comprised of a hinged door with a back edge connected to said rear support leg surface with hinges, a front edge adjacent to said rear support leg surface, and a pair of side edges adjacent to said rear support leg surface.

8. The improved tray and tool case of claim 1, wherein a strap is inserted through said rear support leg surface openings to secure a tool to the interior of said rear support leg surface.

9. The improved tray and tool case of claim 1, wherein said rear support leg front wall includes an opening in the front wall, wherein said rear support leg front wall includes a pair of push pin locks on opposite sides of said opening.

10. The improved tray and tool case of claim 9, wherein said tray surface front wall includes a carrying strap attached to the midsection of said tray surface front wall, wherein said tray surface front wall includes a pair of push pin lock holes.

11. The improved tray and tool case of claim 10, wherein said tray and tool case is closed when said pair of push pin locks engages with said pair of push pin lock holes.

* * * * *